US006619703B2

(12) United States Patent
Dirks et al.

(10) Patent No.: US 6,619,703 B2
(45) Date of Patent: Sep. 16, 2003

(54) KNOT

(75) Inventors: Christiaan H. P. Dirks, Lanklaar (BE); Jozef M. R. H. Goossens, Landgraaf (NL)

(73) Assignee: DSM N.V., Heerlen (NL)

( * ) Notice: Subject to any disclaimer, the term of this patent is extended or adjusted under 35 U.S.C. 154(b) by 0 days.

(21) Appl. No.: 10/106,797

(22) Filed: Mar. 27, 2002

(65) Prior Publication Data

US 2002/0190524 A1 Dec. 19, 2002

Related U.S. Application Data

(63) Continuation of application No. PCT/NL00/00711, filed on Oct. 4, 2000.

(30) Foreign Application Priority Data

Oct. 5, 1999 (NL) ..... 1013216

(51) Int. Cl.[7] ..... D04G 5/00
(52) U.S. Cl. ..... 289/1.2; 289/1.5
(58) Field of Search ..... 289/1.2, 1.5, 18.1; 43/7, 10, 14; 57/310; 87/12

(56) References Cited

U.S. PATENT DOCUMENTS 2,619,704 A * 12/1952 Frontel ..... 289/1.2
3,039,348 A 6/1962 Grabowsky et al.
3,995,898 A * 12/1976 Momoi ..... 289/1.5
4,047,316 A 9/1977 Maruyama
4,226,165 A * 10/1980 Maruyama et al. ..... 87/12
4,711,476 A 12/1987 Hanson
5,749,214 A * 5/1998 Cook ..... 57/310

FOREIGN PATENT DOCUMENTS

GB 1402781 8/1975

* cited by examiner

*Primary Examiner*—Gary L. Welch
(74) *Attorney, Agent, or Firm*—Pillsbury Winthrop LLP

(57) ABSTRACT

The invention relates to a knot in a first and a second rope, each rope having a left and a right end, between which is a turning point, characterised in that, at the turning points, the first and the second rope cross both ends of the second, on one side, and of the first rope, on the other side, respectively, the left and right end of each rope forming an intersection after the turning points and the knot between the intersections comprising at least four crossings of the two ropes.

The invention also relates to a method for making the knot and to the use of the knot in fishing nets. In particular, the invention relates to HPPE fishing nets comprising knots according to the invention.

9 Claims, 3 Drawing Sheets

KNOT

CROSS-REFERENCE TO RELATED APPLICATIONS

This is a Continuation of International Application No. PCT/NL00/00711 filed Oct. 4, 2000 which designated the U.S. and was published in the English language. The contents of this PCT application are incorporated in their entirety by reference.

The invention relates to a knot, in particular to a knot for making a net. Usually the weavers knot is used to knot nets, because such a knot can easily be made mechanically.

A knot in two ropes is generally characterised by two pairs of rope ends, each rope having a left and a right end, and an entwining of the ropes linking the ropes to one another. The points at which, in the entwining in each rope, the left end becomes the right end will here and hereinafter be called 'turning points'. The right and left rope ends are here and hereinafter understood to be the entire lengths of rope after the turning point that ultimately leave the knot on the right and left side, respectively, with any unnecessary crossings that can be avoided without affecting the entwining of the ropes not being considered.

A knot that is frequently used to knot two ropes together is the reef knot. Using the aforementioned definitions, a reef knot can be described as a knot in a first and a second rope with four rope ends, each rope having a left and a right end and the first and the second rope both crossing the ends of the second rope, on one side and the first rope on the other side, respectively, at the turning points, and the left and right ends of the first rope crossing the left and right end, respectively, of the second rope once between the turning points.

Usually the weavers knot is used to knot nets. For plastic fibres commonly used for nets, such as polyamides, polyolefines and polyesters, the weavers knot presents the property that the knot will tighten progressively under stress as a result of these fibres' relatively high elasticity. This phenomenon is not observed in the case of high-performance (HP) fibres, which are far less elastic. 'HP fibres' are here and hereinafter understood to be fibres with a very high modulus and strength such as high-performance polyethylene (HPPE), polyvinyl alcohol, liquid crystal polymers, aramide and polybisoxazoline (PBO). Because of the great strength of fibres of this type, the fibre may have a smaller cross-section, which in the case of fishing nets presents the advantage that a net made from such fibres will displace less water. Trailing such a net will therefore generate less resistance. This will ensure a substantial saving in fuel.

An important characteristic of fishing nets is that all the meshes of a net have the same dimensions. A regular mesh width can easily be disturbed if a net is retained by an obstacle during use. Especially in the case of nets made from fibres with little elasticity, such as HP fibres, this can lead to slippage in the knots in the net, resulting in meshes of unequal size.

Fishing nets with meshes of unequal size involve the disadvantage that the flow resistance in the water increases. Meshes that are too large will moreover let fish of the desired dimensions pass through, while meshes that are too small will retain fish with dimensions below the minimum dimensions of the allowed size of fish to be caught.

The aim of the invention is to provide a knot with a higher knot slip.

A knot in a first and second rope has been found, with each rope having a left and a right end between which is a turning point, characterised in that, at the turning points, the first and the second rope cross both ends of the second rope, on one side, and of the first rope, on the other side, respectively, the left and right end of each rope forming an intersection after the turning points and the knot between the intersections comprising at least four crossings of the two ropes.

By an 'intersection' is understood a spot at which the two ends of one rope cross each other.

By a 'crossing' is understood a spot at which the rope ends of different ropes cross each other.

As a result of this the knot slip is more than doubled whereas the strength of the knot does not, or not appreciably, decrease.

It has surprisingly been found that the knot according to the invention results in a substantial improvement of the knot slip also in the case of the materials usually used for nets, such as polyolefines and polyesters. The two ropes cross at least four times. The greater the number of crossings, the greater the knot slip, but the lower the knot strength. In general, the knot according to the invention will comprise not more than eight crossings of the two ropes. A knot with more than eight crossings has insufficient knot strength, contains a too long stretch of rope and is difficult to tie.

Preferably the knot according to the invention comprises four crossings in the two ropes between the intersections. Such a knot is relatively easy to make. Four crossings of the two ropes between the intersections can be formed in different ways. One way of achieving this is that with which one end of the first rope crosses the two ends of the second rope twice. Depending on whether these crossings involve the left or the right end, we will here and hereinafter call the knot according to the invention DIGO(LxL) or DIGO(RxR), which are represented in FIGS. 4 and 5, respectively. The two knots are mirror images of one another. This knot preferably has three intersections.

Another way of obtaining four crossings of the two ropes is based on the circumstance that each end of the first rope crosses the two ends of the second rope once. This can be achieved in two ways, the resulting knots being mirror images of one another. These knots will here and hereinafter be called DIGO(LxR) and DIGO(RxL) and are represented in FIGS. 1 and 2, respectively. This knot preferably has two intersections.

Preferably the four crossings are formed because each end of the first rope crosses the two ends of the second rope once. This will ensure that the knot slip is the same in both ropes.

The invention also relates to a method for making a knot according to the invention.

The method for making the knot in a first and a second rope according to the invention comprises the following steps (FIG. 3):

a) the free-hanging part of the first rope, which is fixed at both ends, b) is twisted 180° to form a loop, with the left rope end, when viewed from above, lying above the right rope end in a crossing with the right rope end;

c) the second rope is inserted through the loop from behind and passed over the crossing;

d) then the second rope is passed under the part of the left first rope end lying above the crossing and is brought forwards and passed to the right in front of the two first rope ends;

e) is passed via the back of the two ends of the first rope and f) is passed over the left first rope end, under the right first rope end and inserted through the loop from the front.

This method results in a DIGO(RxL) knot.

Another method for making a knot in a first and a second rope according to the invention comprises the following steps:

a) the free-hanging part of the first rope, which is fixed at both ends, b) is twisted 360° to form two crossings, with the right rope end in the bottom crossing, viewed from above, lying in front of the left rope end;

c) the second rope is inserted through the loop from behind and is passed over the part of the right end of the first rope lying above the crossings, after which it is d) passed to the left under the two first rope ends and, e) after being passed over itself, viewed from above, the second rope is passed backwards between the left and right ends of the first rope above the two crossings in the first rope, f) brought forwards between the two crossings in the first rope and g) inserted through the loop from the front.

This method results in the DIGO(LxL) knot.

The knots made with the aid of the methods described above are novel. The invention therefore also relates to knots obtainable with the methods according to the invention.

Known methods for increasing the knot slip of many knots even further are coating the knot, subjecting the knot to a heat treatment, whether or not under stress, or a combination of these two methods.

The invention also relates to the use of the knot according to the invention in manufacturing a fishing net, in particular in manufacturing a fishing net from predominantly HP fibres. Preferably the knot according to the invention is used in manufacturing a HPPE fishing net.

The invention also relates to a fishing net comprising knots according to the invention. Preferably the fishing net according to the invention consists predominantly of HPPE fibres. In particular in the case of nets of HPPE fibres the triple increase in the knot slip involves the advantage that the meshes' resistance to deformation is greatly increased.

The invention will be illustrated with reference to the following figures.

Figure 1:
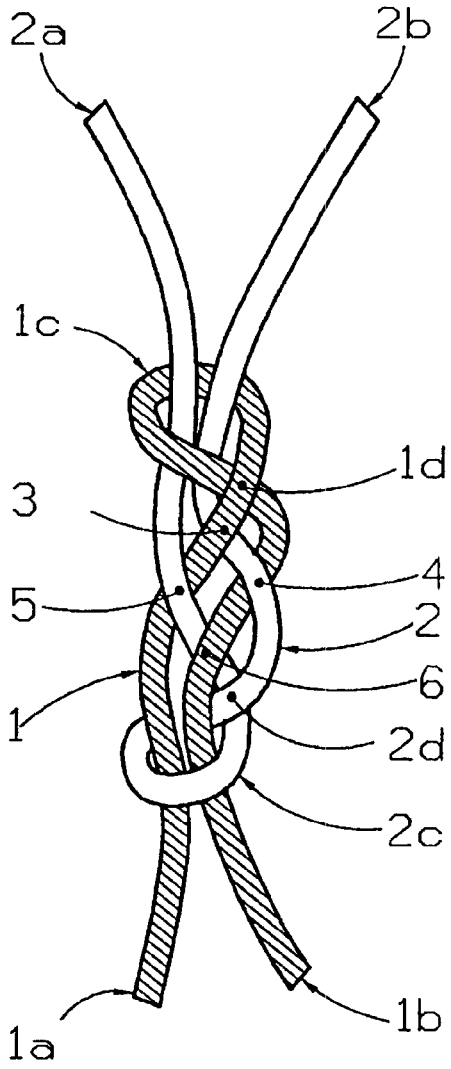
FIG. 1 shows the DIGO(LxR) knot.
Figure 2:
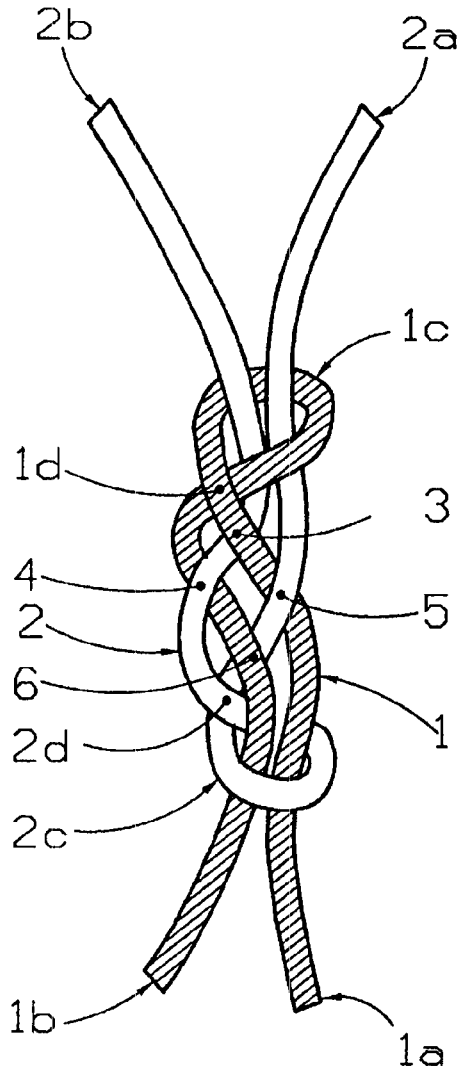
FIG. 2 shows the DIGO(RxL) knot.
Figure 3:
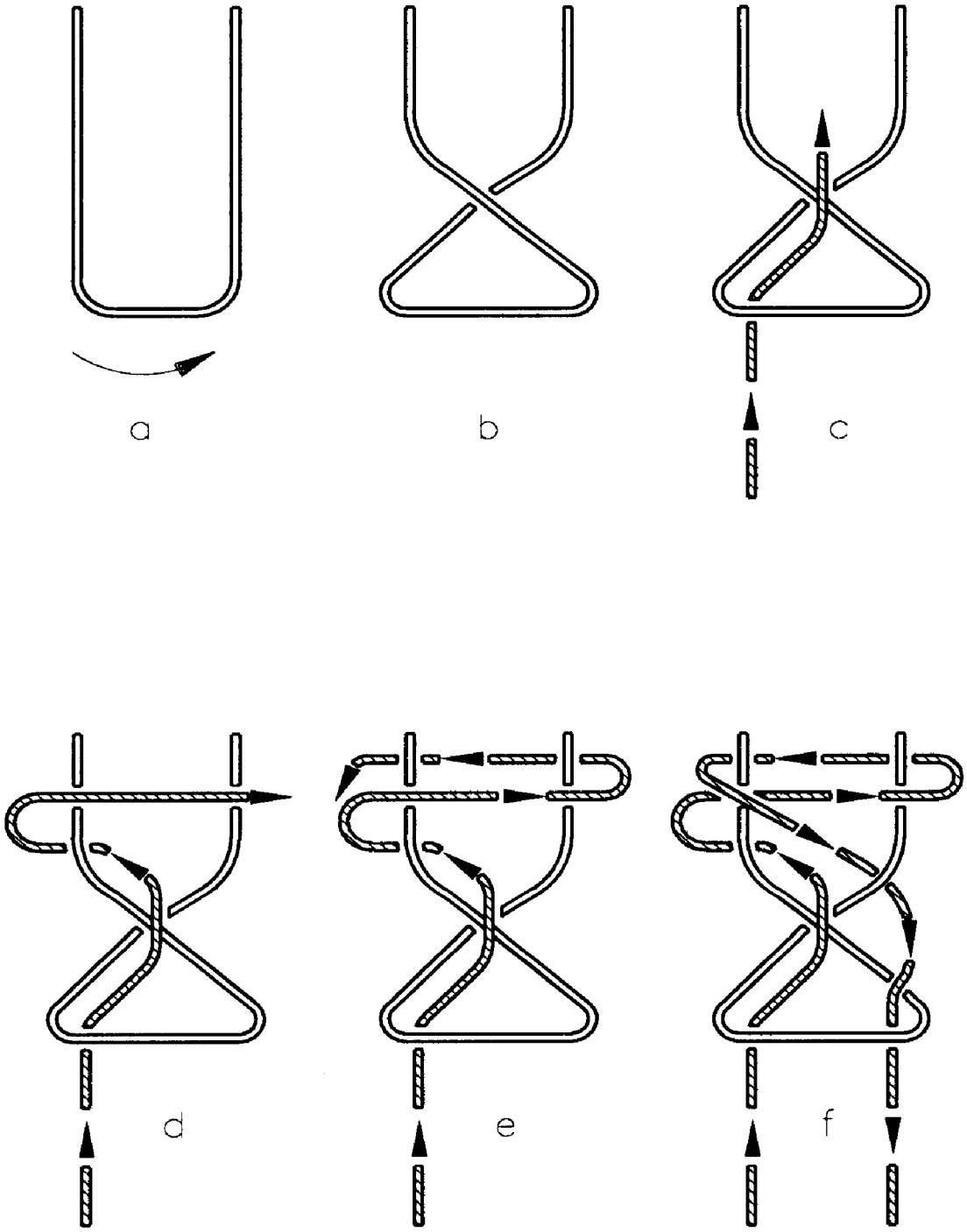
FIG. 3 shows how the DIGO(RxL) knot is made according to the method described above. The letters in the figure correspond to the described steps in the method.
Figure 4:
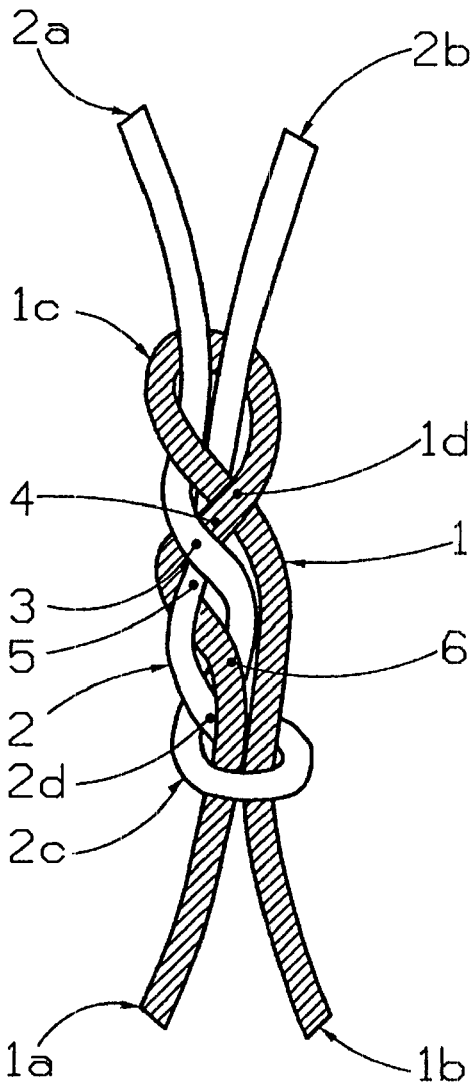
FIG. 4 shows the DIGO(LxL)
Figure 5:
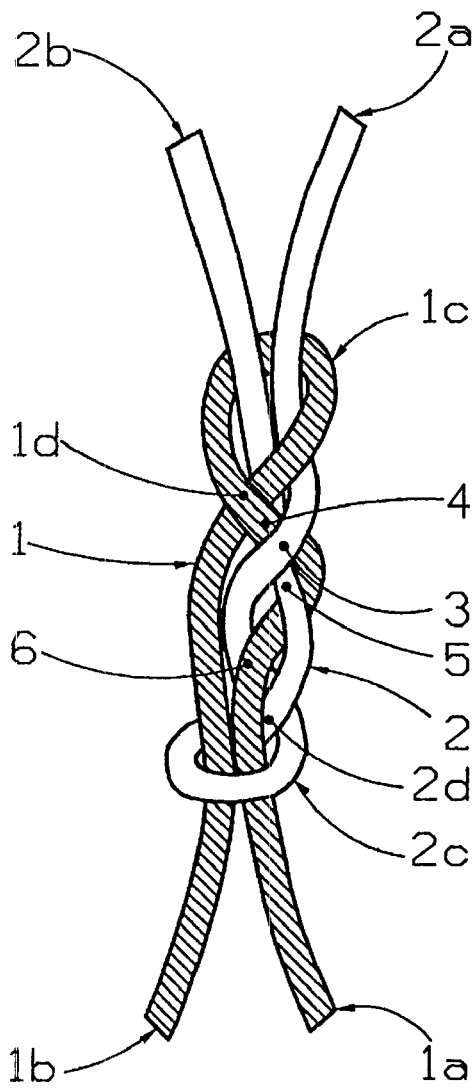

FIG. 5 the DIGO(RxR) knot.

The invention will be further elucidated with reference to the following examples. In these examples use was made of a method for measuring the knot stability as described in "Netting materials for fishing gear", Gerhard Klust, Fishing News Books Ltd, Farnham, England, ISBN 0 85238 118 2, pages 66 and 77. In this method one end of the first rope is first clamped in the grip of a tensile bench and the two ends of the second rope are clamped in another grip of the tensile bench. The specific slip strength is defined as the maximum force observed in the tensile test divided by the rope's yarn dTex. The specific knot strength is determined by clamping both ends of the first and the second rope and carrying out the tensile test. All the tests were carried out five-fold and averaged. The specific slip and strength are expressed in cN/dTex.

EXAMPLE I

Two untreated Dyneema (SK 75) ropes (braid consisting of 16×1760 dTex yarn, 2.75 stitches/cm with a weight of 2.922 g/m) were connected by means of a DIGO(RxR) knot and a DIGO(LxL) knot according to the invention. The knot strength and knot slip of both knots were determined. There where differences in slip were observed between the two ropes, the slip in the rope with the lowest knot slip is indicated as Slip 1. The results are given in Table 1.

TABLE 1

Knot strengths and knot slip of Dyneema knots according to the invention

| Dyneema knot | Strength (cN/dTex) | Slip 1 (cN/dTex) | Slip 2 (cN/dTex) |
|---|---|---|---|
| DIGO(RxR) | 8.60 | 1.60 | 2.00 |
| DIGO(LxL) | 8.60 | 1.60 | 2.00 |
| DIGO(RxL) | 8.00 | 1.80 | 1.80 |
| DIGO(LxR) | 8.00 | 1.80 | 1.80 |

EXAMPLE II

Two Dyneema ropes as in Example I were connected by means of a DIGO(RxL) and a DIGO(LxR) knot according to the invention. The knot strength and the knot slip of both knots were determined. The results are given in Table 1.

EXAMPLE III

Two untreated polyester ropes were connected by means of knots according to the invention as in Examples I and II. The results of the measurements of the knot strength and knot slip are given in Table 2.

TABLE 2

Knot strengths and knot slip of polyester knots according to the invention

| Polyester knot | Strength (cN/dTex) | Slip 1 (cN/dTex) | Slip 2 (cN/dTex) |
|---|---|---|---|
| DIGO(RxR) | 2.6 | 1.3 | 1.4 |
| DIGO(LxL) | 2.6 | 1.3 | 1.4 |
| DIGO(RxL) | 2.7 | 1.2 | 1.2 |
| DIGO(LxR) | 2.7 | 1.2 | 1.2 |

COMPARATIVE EXPERIMENT A

A weavers knot was made in the Dyneema ropes mentioned in Example I and the polyester ropes mentioned in Example II. The knot strength and knot slip of these knots were determined. The results are given in Table 3.

TABLE 3

Knot strengths and knot slip of a Dyneema and a polyester weavers knot

| | Strength (cN/dTex) | Slip 1 (cN/dTex) | Slip 2 (cN/dTex) |
|---|---|---|---|
| Dyneema | 9.5 | 0.5 | 0.7 |
| Polyester | 3.0 | 0.3 | 0.8 |

The comparative experiment shows that the weavers knot has a low knot slip in the case of both polyester and Dyneema. These examples and comparative experiments also show that the knot according to the invention has a much higher knot slip than the weavers knot in the case of both Dyneema and polyester, without the knot strength decreasing appreciably.

What is claimed is:

1. Knot in a first rope (1) and a second rope (2), with each rope having a left end (1*a*, 2*a*) and a right end (1*b*, 2*b*), between which is a turning point, wherein, at the turning points (1*c*, 2*c*), the first rope and the second rope cross both ends of the second rope, on one side, and both ends of the first rope, on the other side, respectively, the left and right end of each rope forming an intersection (1*d*, 2*d*) after the turning points and, the knot between the intersections comprising at least four crossings (3, 4, 5, 6) of the two ropes.

2. Knot according to claim 1, comprising between the intersections four crossings such that each end of the first rope crosses the two ends of the second rope once.

3. Knot according to claim 1, comprising between the intersections four crossings such that one end of the first rope crosses the two ends of the second rope twice.

4. Method for making a knot according to claim 2, comprising:

a) twisting a free-hanging part of the first rope, which is fixed at both ends, 180° to form a loop, with the left rope end, when viewed from above, lying above the right rope end in a crossing with the right rope end;

b) inserting the second rope through the loop from behind and passing over the crossing;

c) passing the second rope under the part of the left first rope end, lying above the crossing and bringing it forwards and passing it to the right in front of the two first rope ends;

d) passing the second rope via the back of the two ends of the first rope and e) passing the second rope over the left first rope end, under the right first rope end and inserting it through the loop from the front.

5. Method for making a knot according to claim 3, comprising:

a) twisting a free-hanging part of the first rope, which is fixed at both ends, 360° to form a loop and two crossings, with the right rope end in the bottom crossing, viewed from above, lying in front of the left rope end;

b) inserting the second rope through the loop from behind and passing it over the part of the right end of the first rope lying above the crossings, after which c) passing the second rope to the left under the two first rope ends and, d) after being passed over itself, viewed from above, passing the second rope backwards between the left and right ends of the first rope above the two crossings in the first rope, f) bringing the second rope forwards between the two crossings in the first rope and g) inserting the second rope through the loop from the front.

6. Method for manufacturing a fishing net comprising forming a plurality of knots according to claim 1 in at least two ropes.

7. Method according to claim 6, wherein the two ropes consist predominantly of HPPE fibers.

8. Fishing net comprising knots according to any one of claims 1–3.

9. Fishing net according to claim 8, which consists predominantly of HPPE fibers.

* * * * *